US006038901A

United States Patent [19]

Stein et al.

[11] Patent Number: 6,038,901

[45] Date of Patent: Mar. 21, 2000

[54] METHOD AND DEVICE FOR PRODUCING PRESS-ROLLED PIPES WITH INNER WALL THICKENINGS AT THE ENDS

[75] Inventors: Bernd Stein, Bonn; Heinz Lehnert, Troisdorf; Wilhelm Zimmermann, St. Augustin; Heinz Steinhauer, Troisdorf, all of Germany

[73] Assignee: Dynamit Nobel Gmbh Explosivstoff-und Systemstechnik, Troisdorf, Germany

[21] Appl. No.: 09/029,222

[22] PCT Filed: Sep. 4, 1996

[86] PCT No.: PCT/EP96/03870

§ 371 Date: Sep. 1, 1998

§ 102(e) Date: Sep. 1, 1998

[87] PCT Pub. No.: WO97/09135

PCT Pub. Date: Mar. 13, 1997

[30] Foreign Application Priority Data

Sep. 7, 1995 [DE] Germany ..... 195 32 951

[51] Int. Cl.[7] ..... B21D 22/16

[52] U.S. Cl. ..... 72/85; 72/370.02; 72/370.25

[58] Field of Search ..... 72/83, 84, 85, 72/283, 370.02, 370.03, 370.15, 370.25, FOR 101

[56] References Cited

U.S. PATENT DOCUMENTS 4,036,044 7/1977 Yoshimura ..... 72/85

FOREIGN PATENT DOCUMENTS 1150611 7/1983 Canada ..... 72/101

0 614 712 9/1994 European Pat. Off. ..... 72/85

*Primary Examiner*—Lowell A. Larson

*Attorney, Agent, or Firm*—Antonelli, Terry, Stout & Kraus, LLP

[57] ABSTRACT

A method for producing press-rolled tubes (3) with a press mandrel (1) and one or more pressure rollers (2), with the tube (3) being arranged between the press mandrel (1) and the pressure rollers (2) and being plastically deformed by means of force loading of the pressure rollers (2). To produce tubes with end wall thickenings, in a first working operation, a first press mandrel (1*a*) with a tailstock-end shoulder (4) is used. The pressure rollers (2) begin their transforming work at the tailstock-end shoulder (4) and work in the direction of the machine spindle. The half-finished tube (3*a*) is taken from the first press mandrel (1*a*), and, in a second working operation, the half-finished tube (3*a*) is clamped at the end with the wall thickening (5) which has already produced into a lathe chuck (6) (tensioning spindle or similar) mounted in the press-rolling machine, and a second press mandrel (1*b*), fastened on the tailstock end and having an outer diameter ($d_2$) which corresponds to the inner diameter of the wall thickening, is pushed into the half-finished tube (3*a*). Then the pressure rollers (2) form the second wall thickening from the tailstock-end in the direction of the machine-spindle end.

6 Claims, 4 Drawing Sheets

METHOD AND DEVICE FOR PRODUCING PRESS-ROLLED PIPES WITH INNER WALL THICKENINGS AT THE ENDS

BACKGROUND OF THE INVENTION

The invention relates to a method and a device for producing press-rolled pipes.

Rotationally symmetrical parts (for example tubes) are required in the structural design of loaded parts in the construction of vehicles (for example bicycle/motorcycle construction) which should be as light as possible, but must have the necessary resistance torques at the loaded positions. For this purpose, with tubular structural parts, for example, the ends are reinforced on the inside, the wall thicknesses in the middle are reinforced on the inside, longitudinal ribs are applied to the inside or combinations of these measures are carried out. Because the outer dimensions of these tubular structural parts cannot be changed for structural reasons, these even being standardized in part (for example in the case of bicycles), these measures are basically applied advantageously to the inside of the tubular workpieces.

These measures for modification of the inner region of the rotationally symmetrical parts have already been known for a long time and are prior art. However, the measures necessary for this purpose are very costly and even today to some extent cannot represent, in practice, justifiable costs. In this way, a tubular structural part for bicycles with inner thickening of the tube ends on both sides can already be produced today. However, for this purpose several costly pulling procedures are required, and on every individual structural part. Because of the method-dependent tolerances dependent upon the method in the conventional production of these parts, any advantage in terms of weight cannot be used in full because of the large tolerance zone of, for example, the uneven walls (differences in wall thickness), because the smallest wall thickness must be considered in the structural calculation.

The generic DE-P 44 46 919 describes a method for flow turning internally geared parts, wherein a workpiece is arranged on a press mandrel, which workpiece is plastically deformed by means of the force loading of pressure rollers. The co-pressing method and the counter-pressing method are described in detail.

In this respect, press-rolling technology allows maximized use of weight advantages as a result of the very small wall thicknesses due to the very high highest levels of hardening of the materials used (steel, steel alloys, aluminium and aluminium alloys, titanium and titanium alloys, copper and copper alloys, special steels etc.) which are attainable and the extremely even thickness of the parts produced. In particular the method allows excellent surfaces to be obtained in the interior of the workpieces, i.e. there is very little roughness. This low surface roughness guarantees special protection against cracks which can start from internal notches in the event of, for example, overstressing. In addition, the method allows high reproducible levels of accuracy. Fluctuations within the workpieces are minimal.

SUMMARY OF THE INVENTION

The object of the invention is to create a method and an associated device with which it is possible to produce tubes which are press-rolled in a cost-favourable manner and with accurate tolerance and which have inner wall thickenings at the ends.

In accordance with the invention the object is achieved by using, in a first working operation, a first press mandrel with a tailstock-end shoulder, by the pressure rollers beginning their transforming work at the tailstock-end shoulder and working in the direction of the machine spindle, by the half-finished tube subsequently being taken from the first press mandrel, by the half-finished tube at the end with the wall thickening which has already been produced being clamped in a second working operation into a lathe chuck (tensioning spindle or similar) mounted in the press-rolling machine, and a second press mandrel, fastened on the tailstock end and having an outer diameter which corresponds to the inner diameter of the wall thickening, being pushed into the half-finished tube, and by the pressure rollers subsequently forming the second wall thickening from the tailstock-end in the direction of the machine-spindle side.

By means of this method, it is possible to produce a tube with inner wall thickenings at the ends using simple means. In the press-rolling machine, only a second press mandrel fastened on the tailstock end is required.

In accordance with the invention the external diameter of the first press mandrel corresponds to the desired internal diameter of the non-thickened middle region of the finished tube, and the external diameter of the shoulder corresponds to the desired internal diameter of the wall thickenings.

In a preferred embodiment, the press mandrel and/or the shoulder is provided on its outside with a profile. The profile can also only be applied to certain sections and advantageously comprises ribs and grooves. However, any other conceivable profile is possible.

In a specific embodiment, the press mandrel and/or the shoulder is at least partially polygonal in cross section, being for example a hexagon. Here the press mandrel is of course understood to mean the first or the second press mandrel or both.

In accordance with the invention this method and this device are particularly suitable for producing structural parts for bicycles/motorcycles.

BRIEF DESCRIPTION OF THE DRAWINGS

Further features of the invention are evident from the figures which are described in detail in the following.

DETAILED DESCRIPTION OF THE PREFERRED EMBODIMENTS

Figure 1:
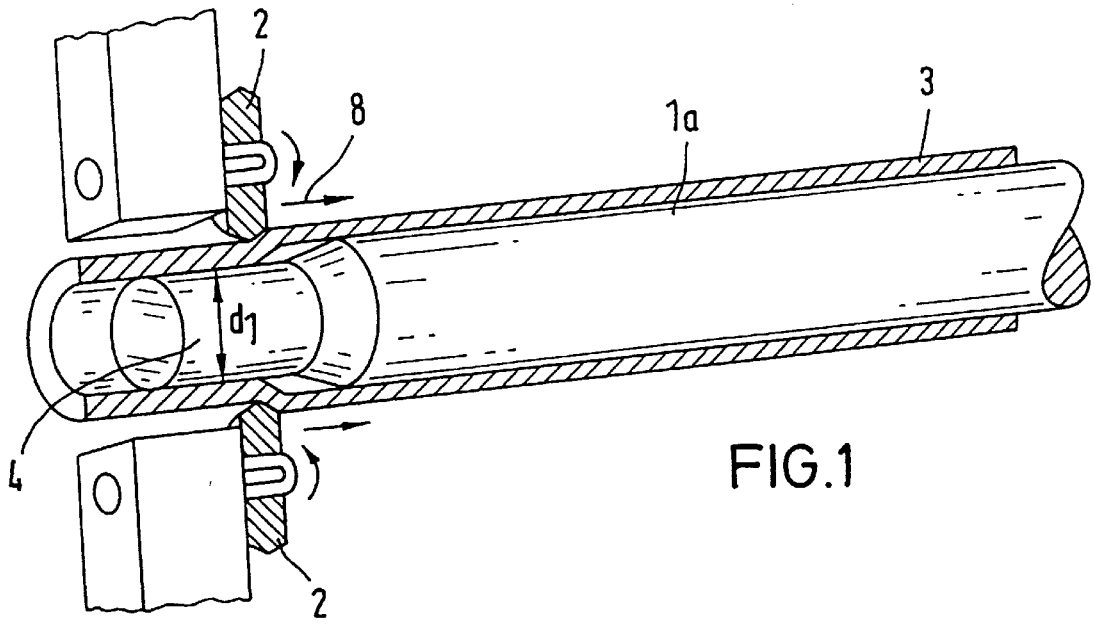
FIG. 1 shows diagrammatically the first working operation for producing a tube with end wall thickenings.

FIG. 1 shows diagrammatically the first working operation on a press-rolling machine for producing a tube 3 with end wall wall thickenings. The tube 3 is arranged on a first press mandrel 1*a* and is plastically deformed by the force loading of the pressure rollers 2. The outer diameter of the first press mandrel 1*a* corresponds in this respect to the desired internal diameter of the middle region of the finished pipe 3 which is not thickened later.

On the first press mandrel la is arranged a tailstock-end shoulder 4, the outer diameter $d_1$ of which corresponds to the desired internal diameter of the end wall wall thickenings of the finished tube 3.

As a first working operation the pressure rollers 2 begin their transforming work at the tailstock-end shoulder 4 and work in the direction of the machine spindle which is not shown. The advance of the pressure rollers 2 is indicated by the reference symbol 8.

Figure 2:
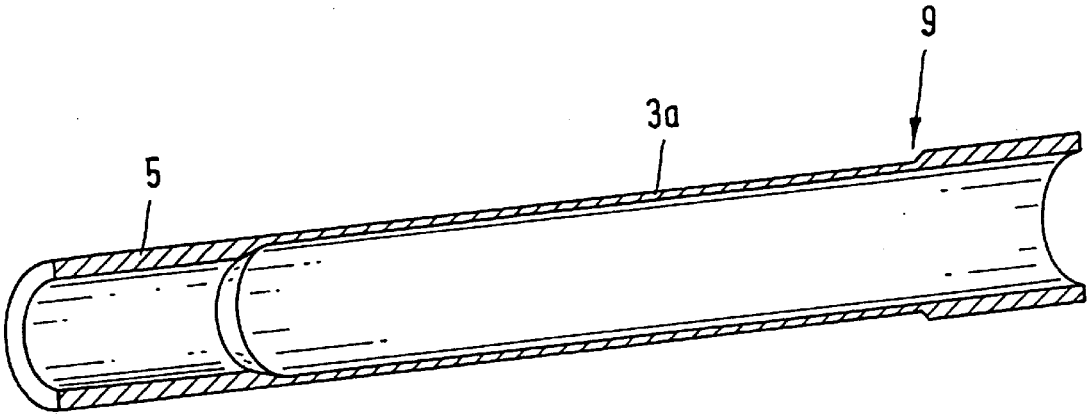
FIG. 2 shows in section the half-finished tube after the first working operation.

FIG. 2 shows the half-finished tube 3*a* produced by means of this working operation with the one-end wall thickening 5 produced on one end. The end of the processing by the pressure rollers 2 is indicated by the reference symbol 9.

Figure 3:
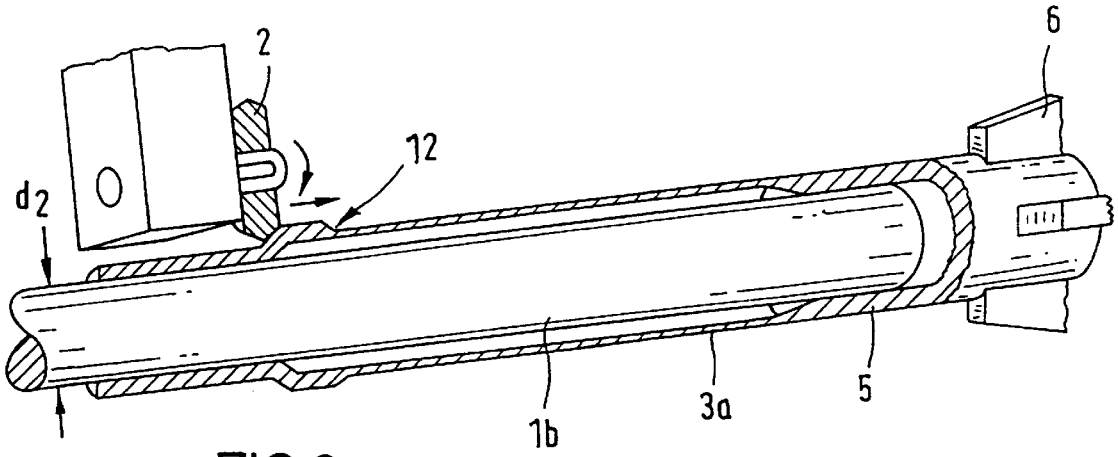
FIG. 3 shows diagrammatically the second working operation.

After the half-finished tube 3*a* is taken from the first press mandrel 1*a*, in a second working operation (see FIG. 3) the half-finished tube 3*a* is clamped into a lathe chuck 6 (tensioning spindle or similar), mounted in the press-rolling machine at the end with the wall thickening 5 which is already produced. Moreover, a press mandrel 1*b* fastened on the tailstock end is pushed into the half-finished tube 3*a*. In this respect, the second press mandrel 1*b* has an external diameter $d_2$ which corresponds to the internal diameter of the wall thickening. Subsequently, the pressure rollers 2 form the second wall thickening from the tailstock-end in the direction of the machine spindle. The end of the processing by the pressure rollers 2 is indicated by the reference symbol 12.

Figure 4:
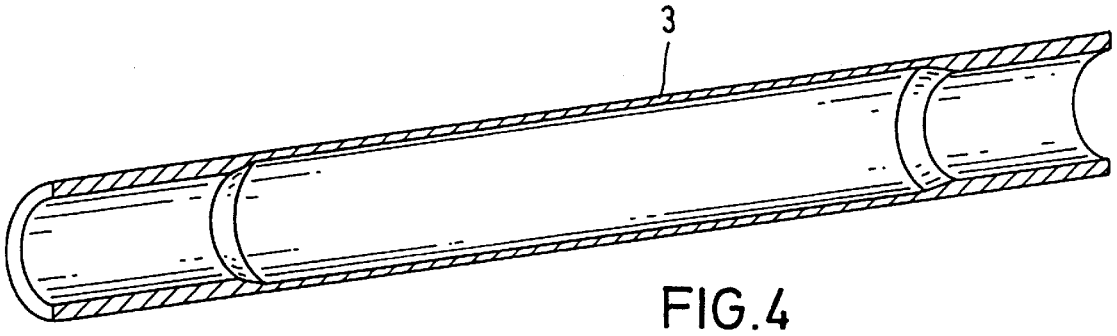
FIG. 4 shows the finished tube with end wall thickenings.

FIG. 4 shows the finished tube 3 with the end wall thickenings.

Figure 5:
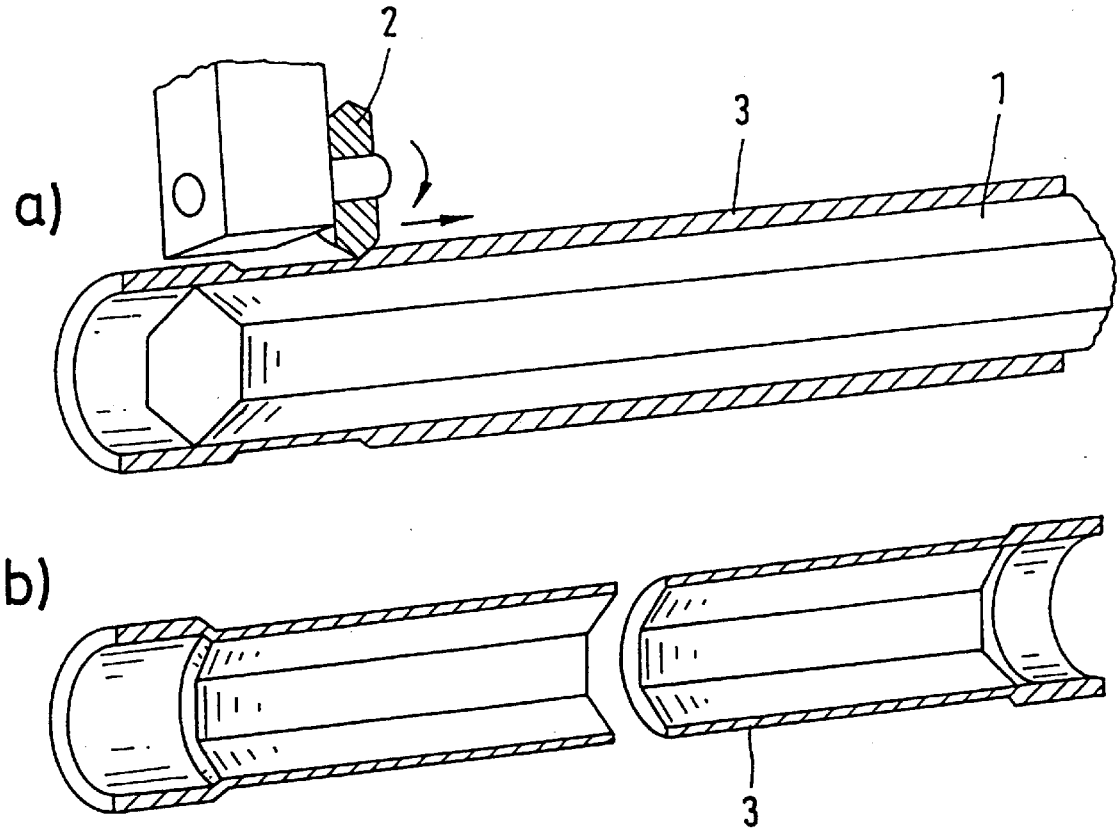
FIG. 5 shows working operation of a tube on a hexagonal press mandrel and the finished tube after the working.

FIG. 5*a* shows a press mandrel 1 having a hexagonal cross section, with a tube 3 being processed by pressure rollers 2. In FIG. 5*b* the finished tube 3 is shown. This press mandrel 1 can be manufactured in the most varied modifications. Always meant by pressure rollers 2 are flow turn rollers.

Figure 6:
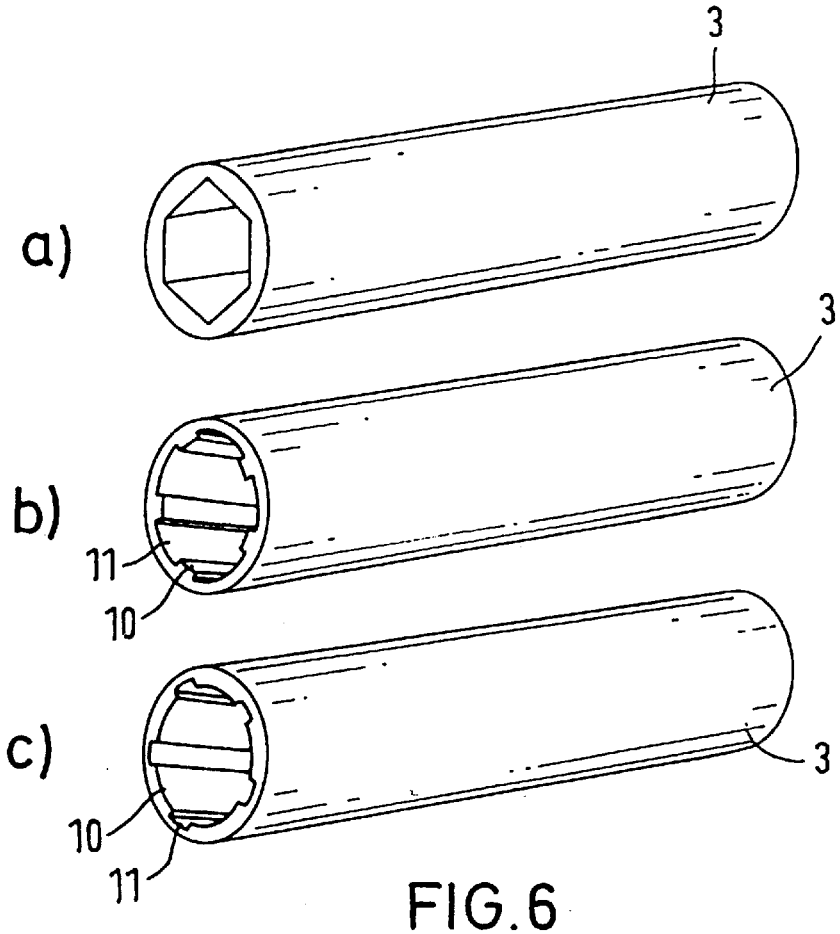
FIG. 6 shows different pipes with different internal profiles.

FIGS. 6 *a,b,c* show three different tubes 3 each with a different internal contour. FIG. 6*a* shows a tube 3 with a hexagonal cross section like FIG. 5*b*. FIGS. 6*b,c* show a tube with ribs 10 and grooves 11.

Figure 7:
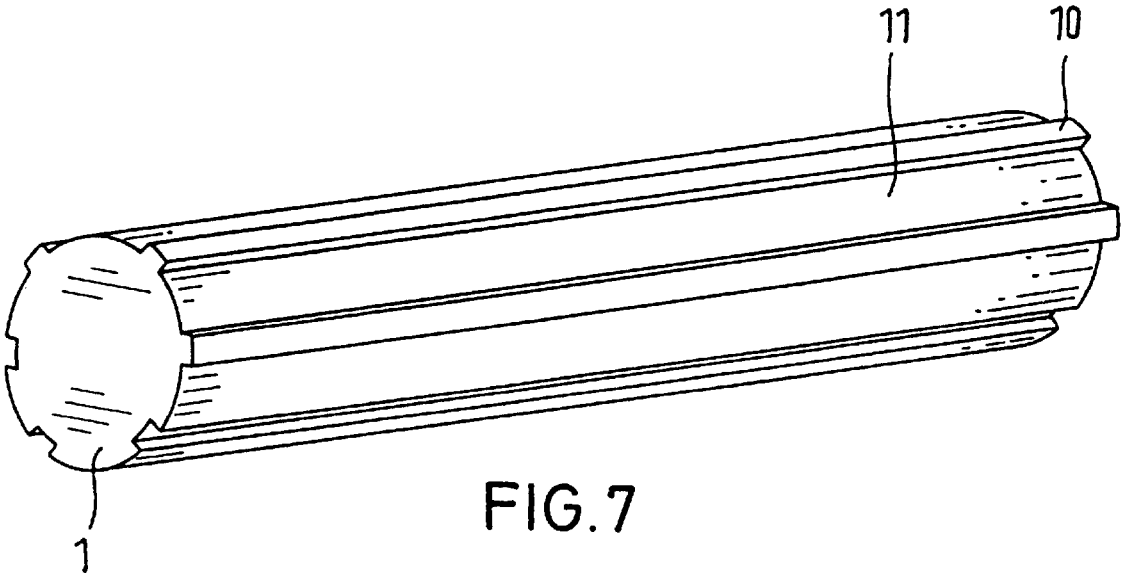
FIG. 7 shows a press mandrel with a profile comprising ribs and grooves.

FIG. 7 shows a pressing mandrel 1 with ribs 10 and grooves 11. A multiplicity of variations of these press mandrels 1 and shoulders, not all of which can be shown here, 4 is possible.

Cold-press-rolled parts can be manufactured with the different tool arrangements described above to modify the interior of these workpieces. To some extent, the desired modifications in the interior of these components can be produced with justifiable costs only with the tool arrangements described. With respect to the bicycle industry this means that high-strength and thin-walled parts can be manufactured with the press-rolling method which have a good chance on the market in the field of racing cycles and racing sport cycles, as well as against aluminium cycles. As a result of good wall evenness, smooth internal surfaces and very high levels of strength with elongation values which are still adequate, it is possible to have thin-walled components which are therefore lighter than components which are customary today. Furthermore, the devices described allow high levels of reproducible accuracy. In this way any one part is like an other because the deviations in values are minimal. By way of variations in the degree of transformation and naturally by way of the modifications in the interior of the parts. The methods allow resistance torques and strengths which are different in part. That is to say, there is the possibility of individually allocating the place with the highest strain to the appropriate resistance torques and strengths. For example, very high strengths at one position and very high elongation values at another position can be combined. Finally, the devices allow the production of conical parts, partially conical parts, perhaps combined with wall thicknesses which in part have different sizes, and with ribs or grooves applied on the inside, in one working operation.

All of these advantages lead to savings in cost in the production of tubular parts as a result of the described modifications in the interior of these workpieces.

We claim:

1. A method for producing press-rolled tubes, comprising:

inserting a first press mandrel with a tailstock-end shoulder into a tube, with the tube being arranged between the first press mandrel and one or more pressure rollers;

plastically deforming the tube by force loading of the pressure rollers beginning at the tailstock-end shoulder and working in a direction of a machine spindle holding the tube to form a half-finished pipe having a wall thickening portion at an end corresponding to the tailstock-end shoulder;

taking the half-finished pipe from the first press mandrel and clamping the half-finished pipe at the wall thickening portion;

pushing a second press mandrel having an outer diameter (d2) which corresponds to the inner diameter of the wall thickening portion into the half-finished pipe; and plastically deforming the half-finished pipe by force loading of the pressure rollers from a tailstock-end towards the clamped end to form a second wall thickening portion at the tailstock end.

2. Method according to claim 1, characterized in that this method is used to produce structural parts for bicycles/motorcycles.

3. A device for producing press-rolled tubes a middle portion and wall thickening end portions, comprising:

a first press mandrel with a tailstock-end shoulder, the first press mandrel having an external diameter corresponding to a desired internal diameter of the middle portion of the tube and the tailstock-end shoulder having an external diameter (d1) corresponding to a desired internal diameter of the wall thickening end portions;

one or more pressure rollers provided around the first press mandrel for plastically deforming the tube by force loading of the pressure rollers; and a second press mandrel having an outer diameter (d2) which corresponds to the desired internal diameter of the wall thickening end portions.

4. Device according to claim 3, characterized in that at least one of the first press mandrel, the second press mandrel and the shoulder is provided with a profile on its outside.

5. Device according to claim 3 characterized in that the profile comprises ribs (10) and grooves (11).

6. Device according to claim 3, characterized in that at least one of the first press mandrel, the second press mandrel and the shoulder is at least in part of polygonal cross section.

* * * * *